US007376218B2

(12) United States Patent
Chapin et al.

(10) Patent No.: US 7,376,218 B2
(45) Date of Patent: May 20, 2008

(54) X-RAY SOURCE ASSEMBLY

(75) Inventors: Fletcher L. Chapin, Maine, NY (US); Liza M. Hart, Nichols, NY (US); Allan O. Johnson, Johnson City, NY (US)

(73) Assignee: Endicott Interconnect Technologies, Inc., Endicott, NY (US)

( * ) Notice: Subject to any disclaimer, the term of this patent is extended or adjusted under 35 U.S.C. 154(b) by 23 days.

(21) Appl. No.: 11/504,609

(22) Filed: Aug. 16, 2006

(65) Prior Publication Data

US 2008/0043919 A1 Feb. 21, 2008

(51) Int. Cl.
*H01J 35/12* (2006.01)

(52) U.S. Cl. ..... 378/130; 378/119

(58) Field of Classification Search ..... 378/119, 378/123, 130, 136, 140, 141
See application file for complete search history.

(56) References Cited

U.S. PATENT DOCUMENTS 3,473,028 A 10/1969 Curry
4,079,217 A 3/1978 Oeschger
4,127,776 A 11/1978 Pickel
4,355,410 A 10/1982 Sullins
4,841,557 A 6/1989 Haberrecker et al.
4,884,292 A 11/1989 Klostermann
5,086,449 A 2/1992 Furbee et al.
5,357,555 A 10/1994 Gerth
5,506,881 A * 4/1996 Ono et al. ..... 378/125
5,802,140 A 9/1998 Virshup et al.
6,254,272 B1 7/2001 Dilick
6,320,936 B1 * 11/2001 Holland et al. ..... 378/140
6,487,273 B1 11/2002 Takenaka et al.
6,494,618 B1 12/2002 Moulton
2002/0020547 A1 2/2002 Negle
2002/0196905 A1 12/2002 Baumgartner et al.
2005/0232395 A1 * 10/2005 Smith et al. ..... 378/121

* cited by examiner

*Primary Examiner*—Hoon Song
(74) *Attorney, Agent, or Firm*—Hinman, Howard & Kattell; Lawrence R. Fraley; Mark Levy

(57) ABSTRACT

An x-ray source assembly capable of producing x-rays suitable for use in medical, explosive detection, and other areas. The assembly includes a housing having a two-part socket member (which holds the assembly's x-ray tube therein) positioned therein. The two-part housing defines an opening through with the tube's x-rays are emitted.

11 Claims, 5 Drawing Sheets

X-RAY SOURCE ASSEMBLY

TECHNICAL FIELD

The present invention relates to x-ray source assemblies, also referred to as x-ray generating devices. More particularly, the present invention relates to an x-ray source assembly which includes a housing, an x-ray tube within the housing, and other support elements designed to optimize assembly operation.

CROSS-REFERENCE TO CO-PENDING APPLICATIONS

In Ser. No. 11,091,521, filed Mar. 29, 2005, there is defined an imaging inspection apparatus which utilizes a plurality of individual imaging inspection devices (e.g., x-ray source assemblies such as x-ray computer tomography devices) positioned on a frame for directing beams onto luggage to detect objects (e.g., explosives) within the luggage based on established criteria. The apparatus utilizes a conveyor to pass the luggage along a path of travel to an inspection location within the apparatus, whereupon the inspection devices direct x-ray beams onto the luggage. The beams are detected and output signals provided to a processing and analysis assembly which analyzes the signals and identifies certain objects which meet the criteria. Ser. No. 11,091,521 is now U.S. Pat. No. 7,177,391, having issued Feb. 13, 2007.

In Ser. No. 11/141,494, filed Jun. 1, 2005, there is defined an imaging inspection apparatus similar to that in Ser. No. 11/091,521 which utilizes a cooling structure to provide cooling to the x-ray imaging devices to assure prolonged life thereof.

In Ser. No. 11/141,349, filed Jun. 1, 2005, there is defined an imaging inspection apparatus also somewhat similar to that in Ser. No. 11/091,521 but which utilizes a different type of cooling structure than defined in Ser. No. 11/141,494 to provide cooling to the x-ray imaging devices to also assure prolonged life thereof. Ser. No. 11/141,349 is now U.S. Pat. 7,261,466, having issued Aug. 28, 2007.

All of the above co-pending applications are assigned to the same Assignee as the present invention.

BACKGROUND OF THE INVENTION

X-ray source assemblies are known in the art, and have been widely recognized as being extremely valuable tools for use in a variety of applications, ranging from the medical field to, more recently, the detection of explosives. With respect to the medical field, for example, such assemblies are commonly used in areas such as diagnostic and therapeutic radiology. With respect to explosives detection, such assemblies have more recently been adapted for use within detection equipment produced by the Assignee of this invention for use in detecting explosives in luggage moving on airline luggage conveyors and the like. Examples of such equipment are defined in the foregoing co-pending patent applications.

Generally speaking, the operation of x-ray source assemblies such as those defined herein is similar. In general, x-rays, or x-ray radiation, are produced when electrons are produced, accelerated to high speeds, and then stopped abruptly. Typically, this procedure occurs within an x-ray tube which includes an evacuated envelope which is usually comprised of glass or a combination of metal and glass. A cathode structure is typically located within the envelope for producing the electrons when the tube is activated. An anode structure is located at a short spaced location (gap) from the cathode structure and designed for receiving electrons emitted by the cathode. A voltage potential is applied between the cathode and the anode which causes the electrons emitted from the cathode structure (also called a filament) to form a thin stream of beams which are accelerated to a very high velocity towards a surface (also called a target) on the anode structure. This anode target surface is comprised of a refractory metal having a high atomic number, so that when the electrons strike it, at least a portion of the resulting kinetic energy is converted to electromagnetic waves of very high frequency, these being the x-rays. The resulting x-rays emanate from the target surface, and are then collimated for penetration into an object, such as the aforementioned luggage moving along a conveyor. As mentioned, when used within explosive detection equipment, these x-rays pass through the luggage, are detected and then analyzed so as to determine the nature of the object or objects within the luggage.

Generally speaking, a relatively minor part of the input energy provided the x-ray assembly results in the production of x-rays. A majority of the kinetic energy resulting from the electron collisions at the target surface is converted into heat, which can reach extremely high temperatures. The heat is absorbed by the anode and is conducted not only to other portions of the anode assembly, but to the other x-ray tube components within the evacuated envelope and, also, to the other parts of the x-ray assembly holding the x-ray tube therein. Over time, this heat can damage the anode, the anode assembly, other tube components and/or other internal parts of the overall assembly, and can reduce the operating life of the x-ray tube and/or the performance and operating efficiency of the tube.

Several approaches have been used to help alleviate problems arising from the presence of these high operating temperatures. For example, in some x-ray devices, the x-ray target, or focal track, is positioned on an annular portion of a rotational anode disk. The anode is in turn mounted on a supporting shaft and rotor assembly that can then be rotated by a motor. During operation, the disk is rotated at high speeds, causing the focal track to continuously rotate into and out of the path of the electron beam such that the electron beam is in contact with any given point along the focal track for only short periods of time. This allows the remaining portion of the track to cool during the time that it takes to rotate back into the path of the electron beam, thereby reducing the amount of heat absorbed by the anode. Although anode rotation reduces the amount of heat present at the focal spot on the focal track, a large amount of heat is still transferred to the anode, the anode drive assembly, and other components within the assembly housing.

Another approach has been to place the housing that forms the evacuated envelope within a second outer metal (e.g., lead) housing which acts as a radiation shield to prevent radiation leakage and further serves as a container for a cooling medium, one well known such medium being oil (also referred to as dielectric oil due to its lack of electrical conductive properties). It is known in the art to use such oil and circulate it by a pump over the outer surface of the inner evacuated housing. As heat is emitted from the x-ray tube components (anode, anode drive assembly (if used), etc.), it is radiated to the outer surface of the evacuated housing, and then at least partially absorbed by the coolant fluid. The heated coolant fluid is then passed to some form of heat exchange device, such as a radiating surface, to allow much of the heat to be removed. The fluid is then re-circulated by the pump back through the outer housing and the process repeated. Oil may also serve as an electrical insulator and reduce the possibility of electrical arcing between the evacuated housing and the outer housing. It is thus essential that the oil be properly circulated within the x-ray assembly.

Some known x-ray sources have eliminated the use of an outer housing and oil as a coolant/dielectric medium. For example, some solutions utilize forced air to remove heat from the evacuated housing and its components. However, these approaches have not been entirely satisfactory for a variety of reasons. For example, known x-ray generating devices that utilize forced air as a cooling medium are adapted for high voltage x-ray applications; such applications typically utilize a 150 kV operating potential, or higher, between the anode and cathode. High operating voltages result in higher operating temperatures, and to ensure sufficient heat removal with air convection, these x-ray tubes typically are equipped with fins, or channels formed on the outer surface of the evacuated envelope so as to enhance heat removal. Understandably, this need for additional structure increases manufacturing complexity, and involves additional physical space requirements for the assembly.

Another concern related to x-ray assemblies and particularly those which operate at relatively high voltages (e.g., those above 150 kV) is the potential for unacceptable arcing between the anode and cathode structures. Such arcs can of course destroy the inner components of the x-ray tube and cause other damage to the overall system. X-Ray tubes have a high internal vacuum and, as a result, the metal internal parts may contaminate the vacuum when the tube is not in use. Normally, such contamination is recombined during the tube's normal operation. If this does not successfully occur, however, the contamination may cause what is referred to as "micro-arcing" or even a major arc. In most cases, micro arcs merely cause an anomaly in the tube's detected data and will self-cure as the tube continues to operate. A major arc, however, will further contaminate the vacuum each time it occurs. Running the tube for a given time period (depending on the extent of arcing damage) will degas the tube so that it can be returned to full service. If the damage is extensive, however, the tube will require replacement. In conventional tube designs, the power supply serves to detect arcs, as evidenced by excessive current flow.

Examples of various x-ray assemblies are described in the following documents.

In U.S. Pat. No. 3,473,028, there is described a relatively small radiographic examination apparatus which includes a housing having walls of a dielectric material, an electrically conductive liner secured to the interior surface of the housing walls and inflow and outflow means communicating with the interior chamber of the housing for permitting the free circulation of an insulating, dielectric medium to and from said chamber.

In U.S. Pat. No. 4,079,217, there is described an apparatus for improving the life of metallic bellows used in a hermetically sealed device having a movable element therein such as in vacuum relays and circuit breakers. The convolutions of the metal bellows are filled by a silicone dielectric gel for an axial length including several such convolutions adjacent the movable end of the bellows, thereby allegedly damping axial mechanical vibrations and preventing excessive stress build-up in the bellows portions adjacent the moveable end.

In U.S. Pat. No. 4,127,776, there is described a conventional x-ray tube and shield assembly for use in dental radiography. The conventional assembly has the x-ray tube affixed within an open-ended cylindrical shield such that the focal point of the tube is centered with respect to a small opening provided in the shield. Positioning of this tube-shield assembly within an x-ray generator is accomplished by trial and error means. The improvement includes an interiorly threaded tubular member extending outwardly from the shield and concentrically around the small opening of the shield. The threaded tubular member is received by a filter element which is disposed within an eye-port opening of an x-ray generator. Since a close dimensional clearance is provided between the tubular member and eye-port opening, the tubular member thus automatically self-centers the x-ray tube and shield within the x-ray generator when the filter element engages the tubular member.

In U.S. Pat. No. 4,355,410, there is described an enclosed, self-contained, air-cooled industrial x-ray machine having a housing which is also a gas-to-gas heat exchanger. The cylindrical metallic housing for the x-ray tube and power transformers is machined to provide a large plurality of narrow radial grooves with intervening narrow vanes on both the inside surface and the outside surface. The outside is covered with a thin-walled cylindrical jacket to provide a plurality of longitudinal passageways. An inside tubular sleeve provides support for the x-ray tube and is adapted to fit closely inside of the inner grooves to provide a plurality of longitudinal passageways on the inner surface. The housing is closed off and sealed with end plates and the interior is filled with a selected heat-transfer and insulating gas at a selected pressure. An internal fan provides circulation of the gas over the x-ray tube and back to the inner longitudinal passageways to the fan. An outside fan circulates room air through the outer longitudinal passageways.

In U.S. Pat. No. 4,841,557, there is described an x-radiator having heat-producing components therein which are enclosed in a housing filled with an insulating fluid surrounding the components. A circulating pump is in fluid communication with the interior of the housing and has respective ports through which the fluid is circulated through the pump between the ports for aiding in dissipating heat from the components. The pump may be integrated within the housing, or attached to an exterior of the housing, with only its ports being in communication with the housing interior. The pump may be a squirrel-cage induction motor with a fluid conveying element, such as a ship's propeller, forming a unit with the rotor and being arranged in a protective housing together with the stator.

In U.S. Pat. No. 4,884,292, there is described an x-ray tube generally comprising an evacuated tube envelope fabricated primarily of metal and having first and second end walls and a cylindrical sidewall, enclosing a rotating anode with its target surface facing the second end wall. A heat transfer sleeve extends from the first end wall past the anode to receive heat from the anode and transfer it to the end wall for dispersal. A heat transfer cross plate at the end of the sleeve further encloses the anode to receive and transfer heat. The tube envelope is mounted within a cylindrical tube housing with the first end wall in contact with a finned mounting plate for dissipating heat. The surface of the tube envelope remains sufficiently cool to apply a layer of lead, whereby the tube is compact. The anode and cathode electrical feeds are through the second end wall. The electrical feeds have angled terminations with lead thereon.

In U.S. Pat. No. 5,086,449, there is described an x-ray tube in which oil is circulated through a heat exchanger to reduce its temperature. More specifically, at least one hot coolant fluid receiving aperture is defined adjacent an end of a suction tube in an upper most portion of a horn portion surrounding a cathode termination assembly. Bubbles of gas in the fluid which could be ionized by electrical fields inside the x-ray tube housing causing x-ray tube current irregularities and corresponding x-ray tube output irregularities are drawn into the suction tube aperture. A de-bubbler removes bubbles from the cooled coolant fluid before it is returned into an anode horn portion of the x-ray tube. Alternatively, the bubbles may be re-absorbed, dissolved, or homogenized by the action of the heat exchanger and pump. The coolant fluid passes through a central portion of the x-ray tube absorbing heat and back to the cathode horn portion.

In U.S. Pat. No. 5,357,555, there is described a method for operating an x-ray installation having an x-ray radiator which comprises an x-ray tube located in a housing filled with an electrically insulating liquid. The electrically insulating liquid is thereby degasified at intervals in order to prevent gases arising as a consequence of the decomposition of the electrically insulating liquid caused by the generated x-ray radiation from deteriorating the high-voltage strength of the x-ray radiator.

In U.S. Pat. No. 5,802,140, there is described an x-ray generating apparatus which is provided with a unitary vacuum enclosure having a rotating anode target and a cathode assembly for generating x-rays transmitted through an x-ray window. The cathode assembly is placed within the vacuum enclosure through an opening in the top wall thereof, and comprises a disk which completely covers this opening. The unitary vacuum enclosure and the disk form a radiation shield. For increasing a thermal capacity of the unitary vacuum enclosure and installing the x-ray generating apparatus into a gantry, it further comprises a mounting block which may be coupled to or encompass the unitary vacuum enclosure. The x-ray window is placed within the mounting block. A window adaptor may be utilized for the X-ray window installation.

In U.S. Pat. No. 6,254,272, there are described methods and apparatus for allegedly extending the life of an x-ray tube which contains an "insert" for generating x-rays. The insert is housed in a housing wherein an insulating fluid circulates around the insert in the housing to provide thermal and electrical insulation. This patent includes methods and apparatus for removing water from insulating oil. One embodiment includes a processor containing a coalescing element for removing water as a vapor from the oil. Other embodiments include methods and devices for drying the interior of the housing. Another embodiment includes a kit containing a processor having a coalescing element for removing water from the insulating oil.

In U.S. Pat. No. 6,487,273, there is described a radiographic apparatus that utilizes a single integral housing for providing an evacuated envelope for an anode and cathode assembly. The integral housing allegedly provides sufficient radiation blocking and heat transfer characteristics such that an additional external housing is not required. The integral housing is air cooled, and thus does not utilize any coolant. In addition, the integral housing is insulated with a potting material, which electrically insulates the integral housing and its components, and also limits the amount of noise emitted from the housing during operation. In an alternative embodiment, enhanced thermal and electrically insulating properties are allegedly achieved through the use of a potting material disposed in selected areas of the tube interior. The potting material cooperates with optimized airflow through the tube assembly to effectively and continuously remove heat there-from.

In U.S. Pat. No. 6,494,618, there are described devices for improved radiation attenuation in devices which generate x-ray radiation. A high voltage receptacle is disclosed, the receptacle being adapted to accommodate a high voltage connector to supply power to an x-ray tube and being formed of a mixture of a dielectric material and an x-ray attenuating material, such as an x-ray attenuating metal compound. X-ray radiation impinging upon the high voltage receptacle that would otherwise pass through the unshielded receptacle is absorbed or scattered by the x-ray attenuating material without the need for additional x-ray shielding. Also disclosed is an x-ray housing assembly including an x-ray housing adapted to contain an x-ray tube, and a high voltage receptacle, wherein the high-voltage receptacle and optionally a portion of the x-ray housing is formed of a mixture of a dielectric material and an x-ray attenuating material.

In Printed Patent Application Number US2002/0020547 A1, there is described a high-voltage generator which is proportioned so as to realize a particularly low weight in combination with a high output power and is suitable notably for use in rotating x-ray systems such as computed tomography apparatus. To this end, the high-voltage generator is provided with a hybrid insulation which is formed as far as possible by high resistance foam and an insulating liquid. The foam is shaped and arranged in such a manner that there are formed channels through which the insulating liquid can flow in areas requiring a discharge of heat or an electric strength stronger than can be ensured by the high-resistance foam alone.

In Printed Patent Application Number US2002/0196905 A1, the useful life of x-ray tubes is allegedly extended by filtering metal particles and other decomposition products out of the coolant fluid by filter means permanently included in the closed loop cooling fluid circuit which also includes pump means and heat exchange means.

In Printed Patent Application Number US2005/0232395 A1, there is described a dielectric connector for use in high voltage devices, including x-ray tubes. The connector comprises a dielectric material and is pre-formed before attachment to the x-ray tube. Pre-formation of the connector creates a first cavity portion therein that conforms in shape to a corresponding segment of the tube surface. A second cavity portion is also defined for receiving a high voltage receptacle. Upon attachment to the tube, the first cavity portion receives the corresponding tube segment. The high voltage receptacle is received into the second cavity portion and electrically connects with a receptacle defined on the tube surface. The receptacle enables a high voltage signal passing through the electrode to connect with either the anode or cathode disposed within the tube. Pre-formation of the connector enables connector testing and repair to occur before it is attached to the tube, saving resources, time, and cost.

As understood from the following, the present invention represents an improvement to known x-ray source assemblies in which an x-ray tube is used and located within a housing. The present invention provides for enhanced cooling of the x-ray tube and other internal parts of the assembly while also assuring an effective means of electrically coupling the x-ray tube to the necessary electrical connections through which the x-ray tube is electrically powered. Still further, the invention provides for means for detecting for undesirable arcing between the anode and cathode structures of the x-ray tube to thereby inform the assembly operator of potential harm or destruction of the assembly. Additional features of the invention will be readily discernible from the following detailed description.

It is believed that an x-ray source assembly having such desirable features and others discernible from the following teachings will represent a significant advancement in the art.

OBJECTS AND SUMMARY OF THE INVENTION

It is, therefore, a primary object of the present invention to enhance the x-ray source assembly art.

It is another object of the invention to provide an x-ray source assembly which provides for enhanced cooling of the assembly, ready detection of undesirable arcing between the anode and cathode elements of the assembly and enhanced connectivity of the x-ray tube to the electrical connections which provide power to the assembly.

It is yet another object of the invention to provide such an x-ray source assembly which can be manufactured at acceptable costs to the ultimate consumers thereof.

According to one aspect of the invention, there is provided an x-ray source assembly comprising a housing, an x-ray tube including a first end portion having an anode therein and a second end portion having a cathode therein, this x-ray tube adapted for emitting x-rays during operation of the x-ray source assembly, and a socket member positioned within the housing and including a first part and a second part, the first part and/or said second part defining an opening therein, the x-ray tube being positioned within the socket member when emitting x-rays during operation of the x-ray source assembly, these x-rays passing through the defined opening.

BEST MODE FOR CARRYING OUT THE INVENTION

For a better understanding of the present invention, together with other and further objects, advantages and capabilities thereof, reference is made to the following disclosure and appended claims in connection with the above-described drawings. It is understood that like numerals will be used to indicate like elements from FIG. to FIG.

By the term "x-ray tube" as used herein is meant an x-ray radiation emitting lamp including a glass envelope with end portions (usually opposing), one end portion having an anode structure and the other end having a cathode structure. Examples of such x-ray tubes are described in various ones of the foregoing documents.

By the term "x-ray source assembly" as used herein is meant a structure designed for housing an x-ray tube therein and for providing connections means to electrically couple the x-ray tube to a suitable power source such that the tube can function as intended, and also for cooling the x-ray tube during operation of the assembly. Examples of such assemblies are described in various ones of the foregoing documents.

By the term "socket member" as used herein is meant a socket structure designed for having an x-ray tube positioned therein such that the tube can be electrically coupled to the power source through the x-ray source assembly's connection means.

Figure 1:
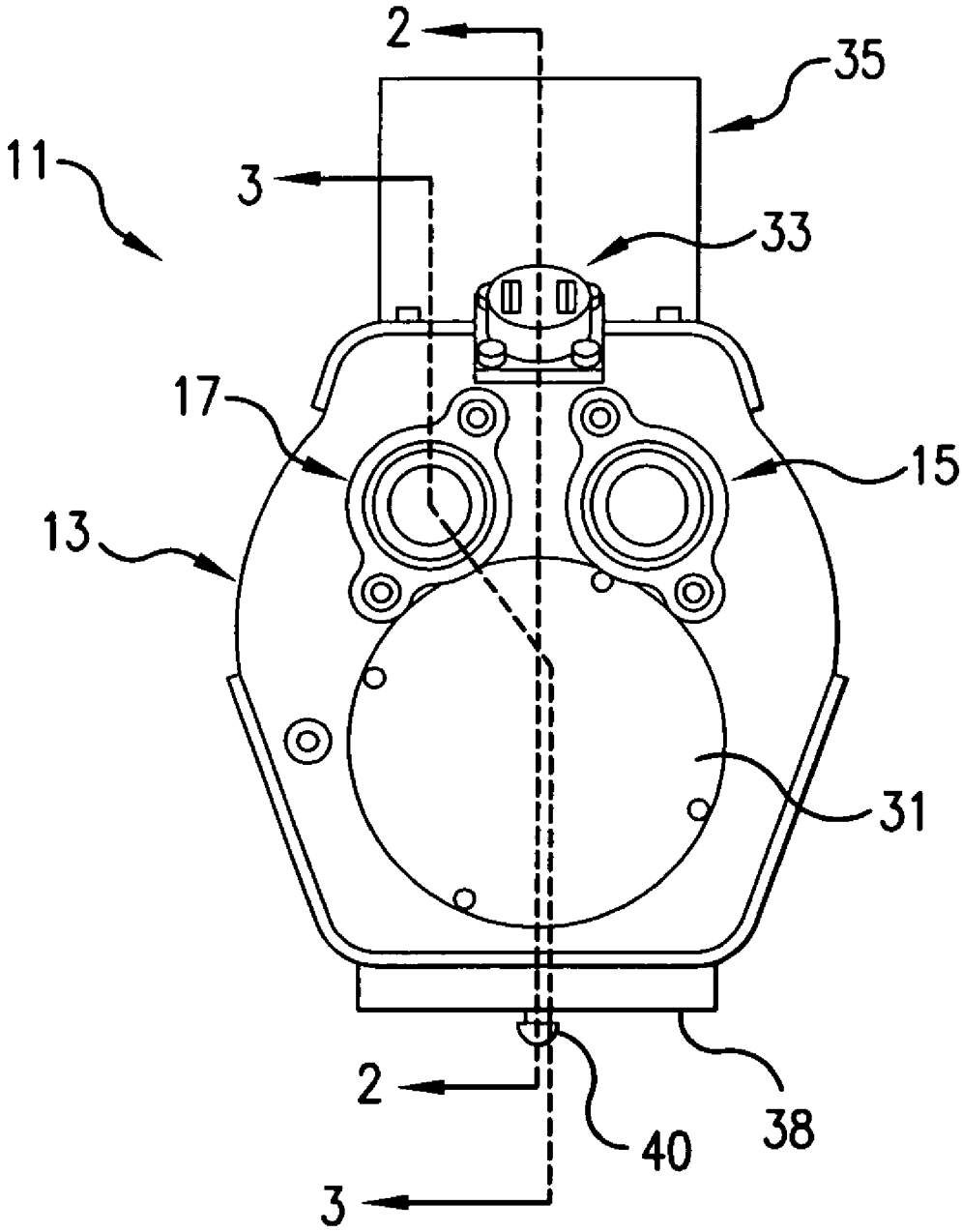
FIG. 1 is an end view of an x-ray source assembly according to one embodiment of the invention.
Figure 2:
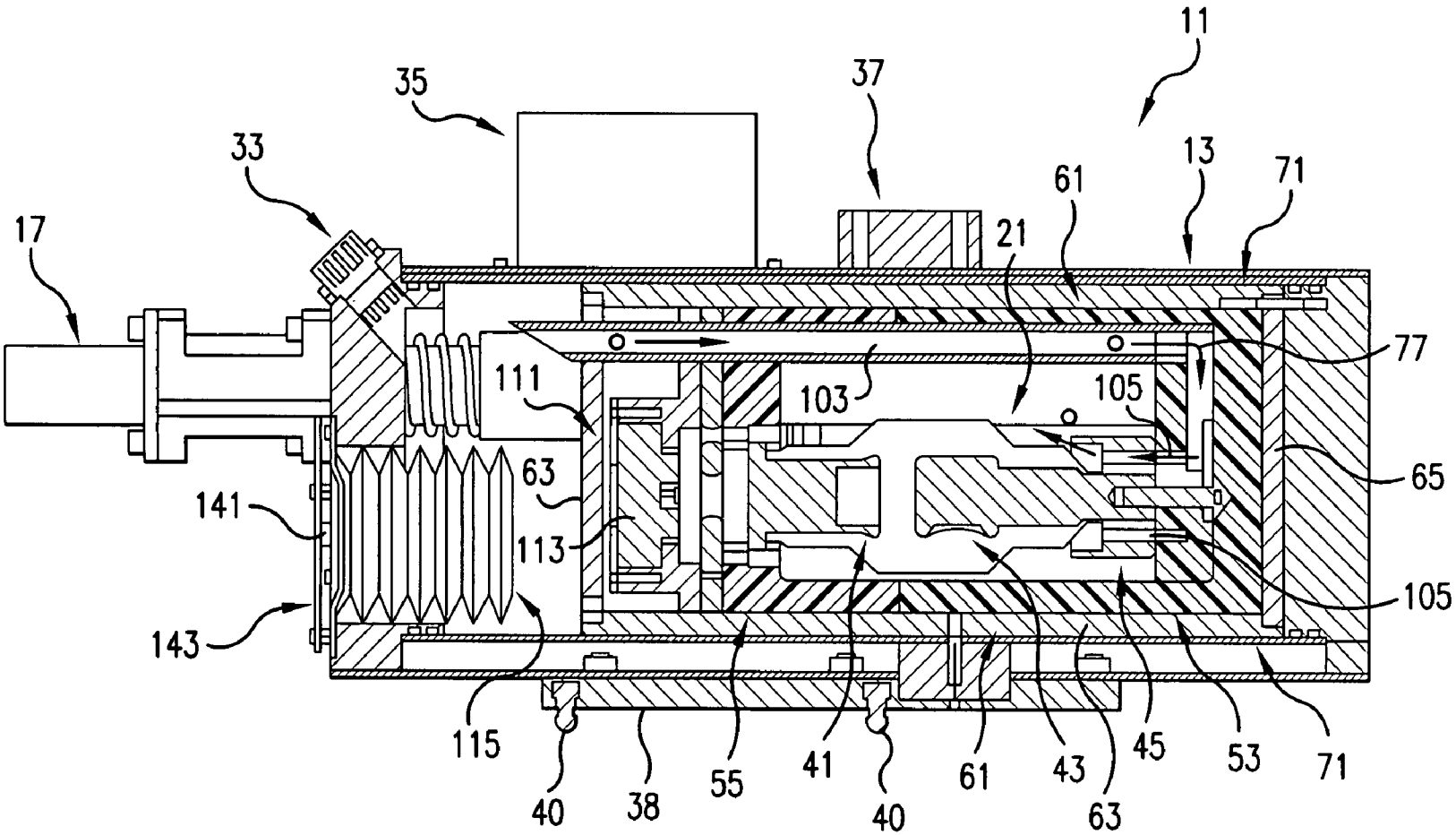
FIG. 2 is a side view, partly in cross-section, showing the x-ray source assembly of FIG. 1, as taken along the line 2-2 in FIG. 1.
Figure 3:
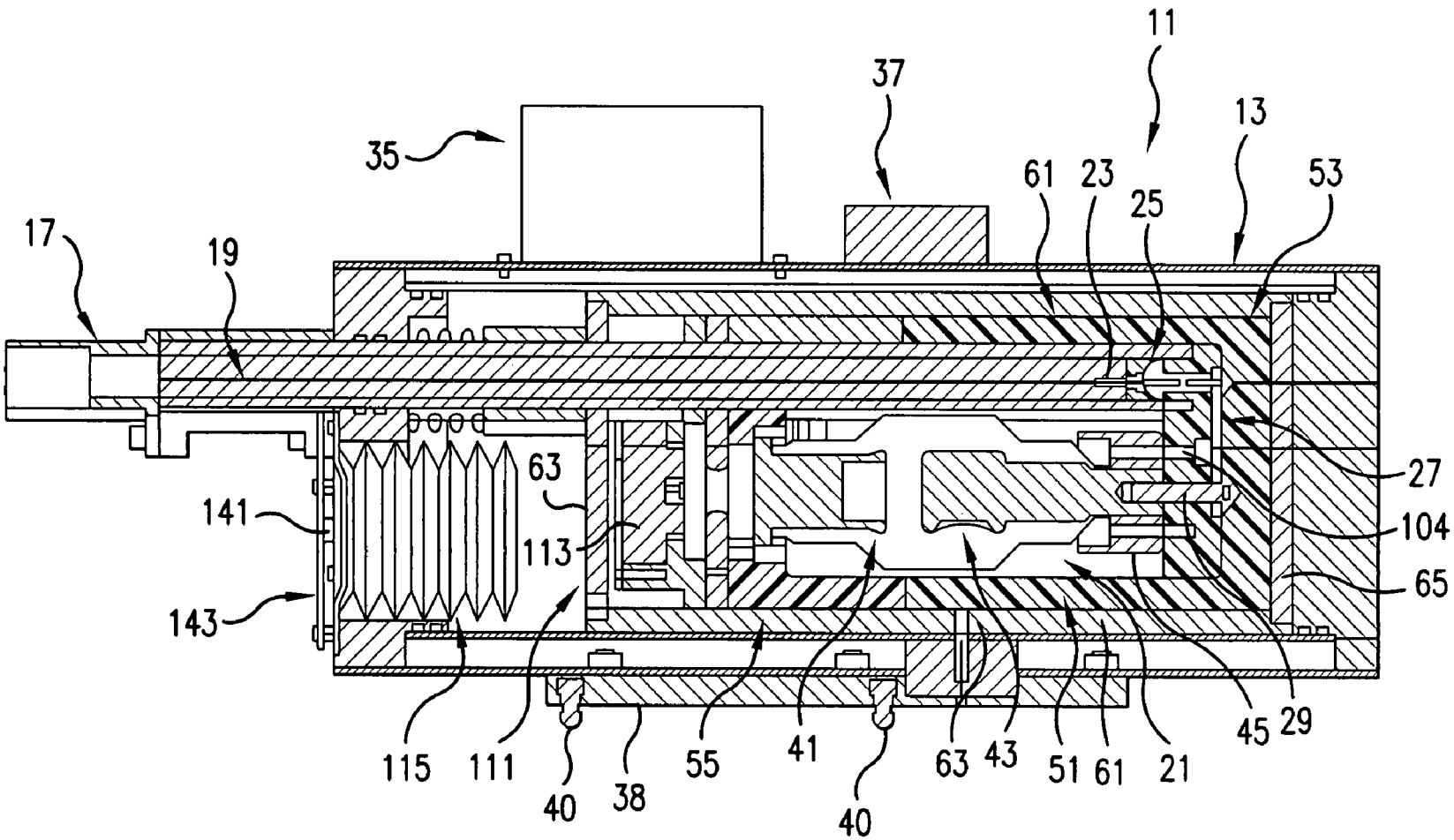
FIG. 3 is also a side view, partly in cross-section, showing the x-ray source assembly of FIG. 1, as taken along the line 3-3 in FIG. 1.

In FIG. 1, there is shown an x-ray source assembly 11 according to one embodiment of the invention. Assembly 11 includes an outer housing 13 and two power cable ports 15 and 17, the latter designed for accommodating the high voltage power cables 19 (one shown in FIG. 3) designed for providing electrical power to the assembly's x-ray tube 21 (FIGS. 2 and 3) positioned within the assembly. As seen in FIG. 3, cable 19 ends in a "banana" plug 23 and "banana" mounting plug post 25 assembly which in turn is electrically coupled to a conductor plate 27. Plate 27 is in turn electrically coupled to x-ray tube 21 by a conductor bolt 29 which threads into the end of tube 21 as shown. As further seen in FIG. 1, assembly 11 further includes a substantially annular end plate 31 secured to the outer housing 13 just below the two power cable ports 15 and 17. Assembly 11, as also shown in FIG. 1, further includes an end connector 33 which projects upwardly at an angle relative to the central axis of the assembly (when viewed from the side as in FIGS. 2 and 3). Connector 33 is designed for providing electrical coupling to various internal elements of the invention, to be defined in greater detail below. FIG. 1 also illustrates a control module 35, which is positioned atop the outer housing 13 and secured thereto. Control module 35 is also seen in FIGS. 2 and 3, adjacent lifting block 37, which is also secured to the outer housing. The lifting block functions to provide a hoisting point for installation and removal of the assembly. Finally, assembly 11 as illustrated in FIG. 1 is shown to include a mounting flange 38 and at least two locating pins 40 (see also FIGS. 2 and 3) for mounting assembly 11 within a suitable structure such as that defined in the above-identified pending application under Ser. No. 11,091,521.

X-ray tube 21 is preferably an industrial x-ray tube, and in one embodiment of the invention, is one sold by Varian Medical Systems, having a business location at 1678 S. Pioneer Road, Salt Lake City, Utah, under the product designation "V160-32G." This is not meant to limit the invention, however, as other x-ray tubes may be successfully utilized as part of the instant invention. Briefly, an x-ray tube is a device for generating a particular kind of electromagnetic radiation. Each one is made up of a negatively charged cathode and a positively charged anode. Like a light bulb (or lamp), the cathode contains a filament. Voltage, or current, is applied to the filament, producing a stream of electrons that hurtle the short distance into the metal anode at nearly the speed of light. The collision produces x-rays. The cathode/anode assembly sits in an internal (of the glass bulb) lead-lined housing to prevent radiation from being emitted in all directions. A vacuum is created within this internal housing so that the electrons can move with the greatest possible speed from the cathode to the anode. A hole in the housing directs the x-rays out of the tube. The penetration power of the x-rays coming from a particular tube is dependent on the level of voltage it can handle. Tubes that run at 40,000 volts (40 Kv) can penetrate a small sample of material. Generating x-rays that can penetrate baggage and the human body, for example, require greater voltage levels, and, in the case of x-ray tube 21, are 160 Kv. Baggage inspection x-ray tubes can operate at higher voltages, including 250, and even 300 Kv. As mentioned above, only about a half of a percent of the total energy in an x-ray tube is converted to useable x-rays. About 99.5 percent of the energy becomes useless heat.

In the embodiment of the invention as shown in FIGS. 2 and 3, the cathode 41 is shown to the left end portion of tube 21 while the anode 43 is shown to the right end portion. As explained, the cable 19 is connected to the anode 43 (via bolt 29). The "V160-32G" x-ray tube as used in the invention includes a tungsten filament for the cathode and operates at 160 Kv maximum. It can provide up to 320 continuous watts with a forty-degree target angle and x-ray coverage of seventy-six degrees. Tube 21 includes a copper hood 45 surrounding the anode end. The tube has a length of about 7.3 inches and weighs only about 2 pounds (1 kg.). The glass includes beryllium to assure low filtration which reduces glass wall charges as well as stray radiation by intercepting secondary electrons.

According to the teachings of the invention, x-ray tube 21 is held within a socket member 51 which is comprised of polymer material (a preferred polymer being polyethylene and, more particularly, Ultra High Molecular Weight Polyethylene (UHMWPE), as defined by ASTM D4020-01, which provides a breakdown voltage of 1000 volts per mil.) which provides electrical insulation, and, because of its higher electrical strength, allows for the use of a smaller diameter lead shield (lowering the weight of the assembly in comparison to many known structures designed for having an x-ray tube positioned therein). The socket member 51 does not provide significant radiation shielding because it has a low attenuation rate for x-rays, which is deemed important in this invention. Weight reduction is a primary concern with respect to x-ray assemblies used in apparatus such as baggage inspection machines wherein several such assemblies are utilized. A lesser weight assembly is easier to load and unload, and easier to align within the inspection machine. Significantly, the polymer socket member of the invention is of two-part construction, with one part (53) designed to have the end portion of x-ray tube 21 having the anode 43 therein within said part while the other part (55) accommodates the other end portion of the x-ray tube 21 having the cathode therein. See FIGS. 2, 3 and 4. Parts 53 and 55 are positioned with an abutting orientation within a lead (Pb) shielding structure 61, which serves to substantially surround (and thereby shield) the x-ray tube and its associated socket member. Shielding structure 61 includes a tube member 61' and end caps 63 and 65 and, as seen, is of substantially cylindrical configuration. In addition to shielding structure 61, assembly 11 further includes a metallic cylindrical member 71, which surrounds the sides of tube member 61'. Member 71 is preferably of aluminum or other sound heat conducting metal and is designed for electrical shielding and oil retention. Significantly, member 71 also provides mechanical structure for the invention because it is coupled to the lifting block 37, which in turn ties into the aluminum body.

Figure 5:
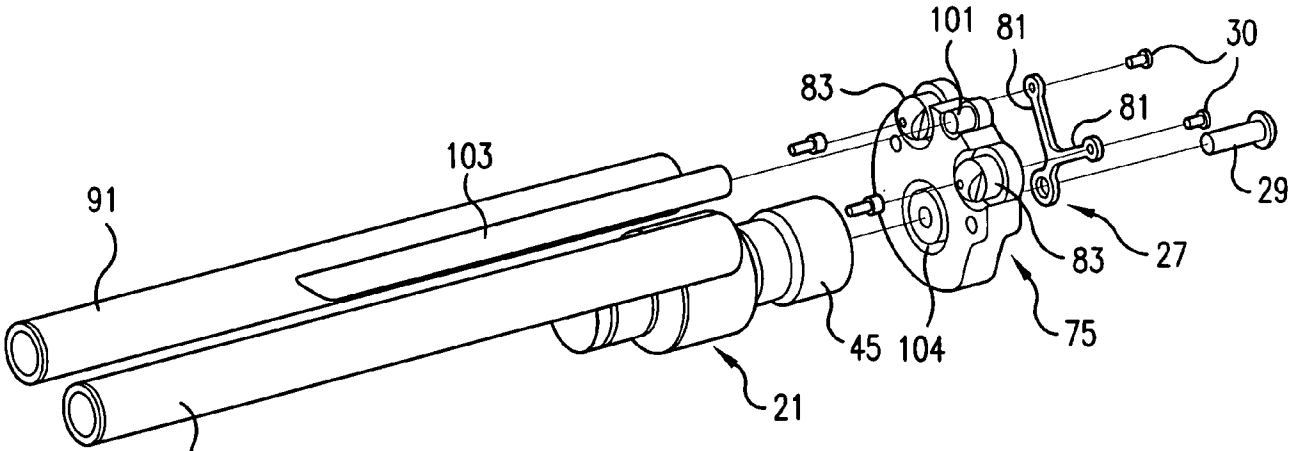
FIG. 5 is an exploded perspective view of the x-ray tube and socket base of FIG. 4 shown adjacent the cooling oil tubes which also form part of the x-ray source assembly according to one embodiment of the invention.
Figure 4:
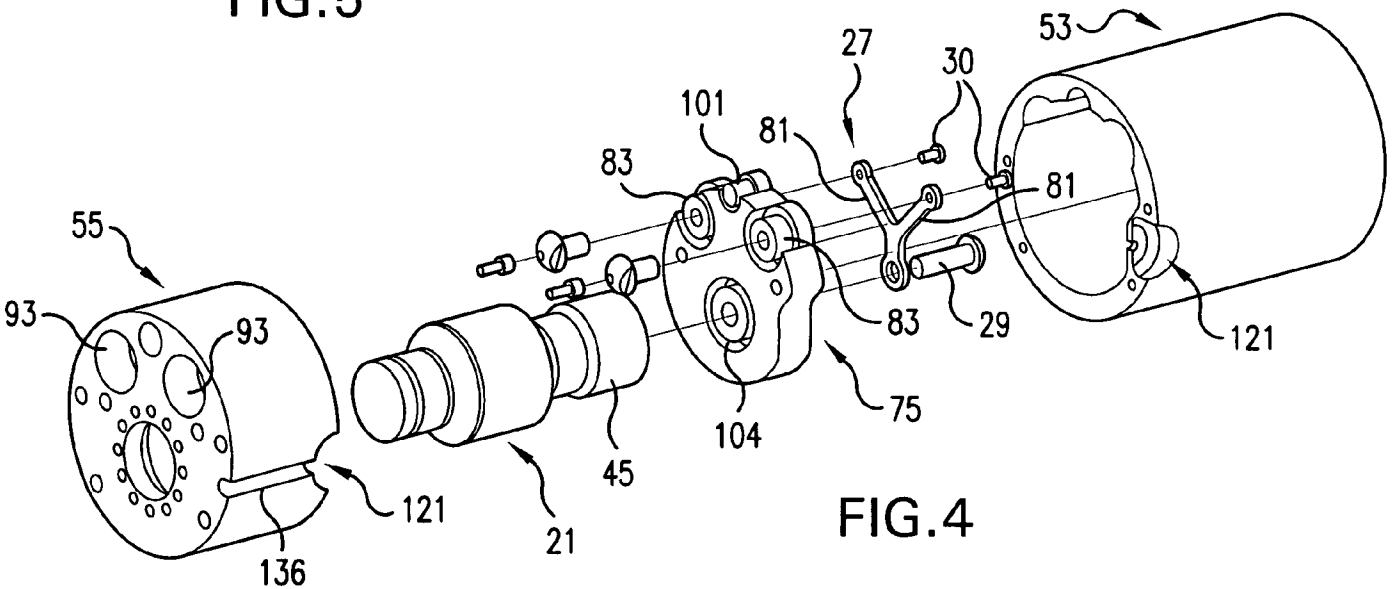
FIG. 4 is an exploded perspective view of the socket member, socket base and x-ray tube arrangement according to one embodiment of the invention.
Figure 6:
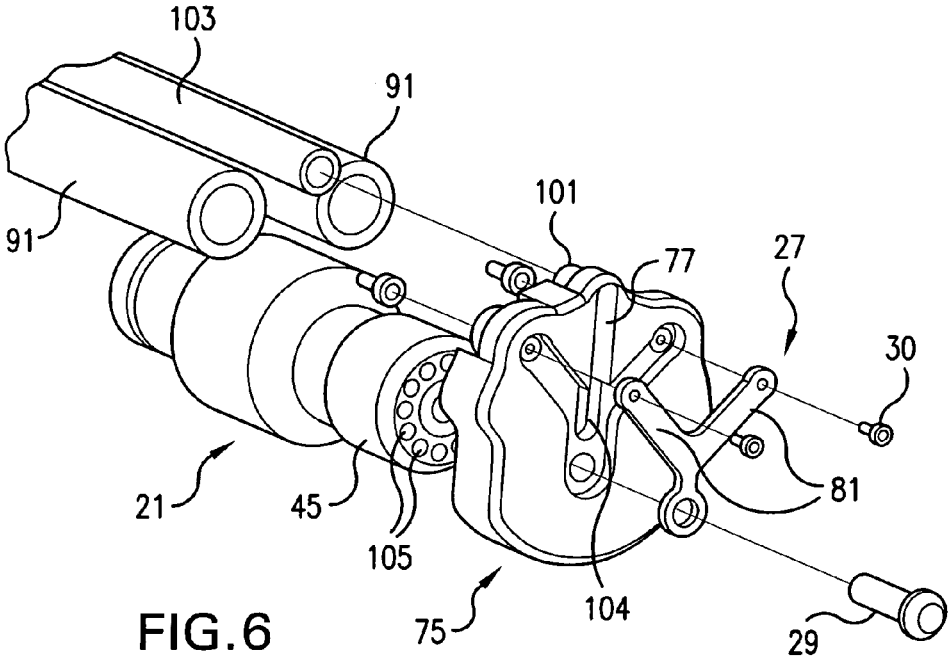
FIG. 6 is a partial exploded perspective view of the structure of FIG. 5, taken from an opposing end thereof.

As seen in FIGS. 4, 5 and 6, a socket base 75 is also employed and adapted for having the copper hood 45 of x-ray tube 21 positioned there-against. Base 75 is also preferably of polymer material and, more preferably, of the same material as parts 53 and 55. Base 75 fits snugly within part 53 of the socket member (see also FIGS. 2 and 3) and, significantly, defines a channel 77 (see also FIG. 2) within its rear wall so as to allow oil to pass there-through as part of the cooling of tube 21. Base 75 also has the defined conductor plate 27 secured thereto (at its back surface, using bolts 29 and 30) with upwardly extending arms 81 which align with corresponding receiving ports 83 within the base for accommodating the ends of the cylindrical tubes 91 which house the high voltage power cables 19 (not shown). As seen in FIG. 4, each of the tubes 91 passes through associated apertures 93 within part 55 of the socket member. As defined above with respect to FIG. 3, the cables 19 are electrically coupled to plate 27 (understood from FIGS. 4, 5 and 6 to be to upward arms 81) which converge at the base of the "Y"-shaped plate and allow bolt 29 to pass there-through into x-ray tube 21 to form the end connection therewith. Bolts 30 also provide connection in a similar manner. Significantly, base 75 further includes an oil passage port 101 which accommodates the cylindrical open end of an oil tube 103 (see also FIG. 2) designed for having cooling oil pass there-through whereupon the oil will pass down through channel 77, through annular oil port 104 within the base, and into a plurality of parallel oil ports 105 within copper hood 45 of the invention's x-ray tube 21. This passage of oil is partly represented in FIG. 2 by directional arrows "O." Effective oil flow is essential to assure optimal cooling of the hot x-ray tube during its operation, as explained above. The oil is pumped through assembly 11 by an internal pump 111 (FIGS. 2 and 3) which is driven electrically. Electrical connections to the pump include internal wiring (not shown) which extends to connector 33. Pump 111 is able to pump the desired cooling oil at a rate of from about 0.5 liters per minute (LPM) to about one LPM, depending on the heat generated by tube 21. The pump 111 includes an impellor 113 which is axially rotated on a shaft (not shown), and a tachometer output from the pump is read by a circuit on the arc detector board to determine if the pump is operating properly. The internal pump-impellor assembly is able to cool the x-ray tube effectively so as to assure prolonged life thereof. In addition to the pump, assembly 11 further includes a bellows 115 (FIGS. 2 and 3) which is designed to expand or contract, depending on oil temperature. Bellows 115, in addition to providing for volumetric changes in the cooling oil, provides a sounding diaphragm that, when used in conjunction with the microphone on the arc detector board, make it possible to detect arcs within the housing but external to the tube.

Figure 7:
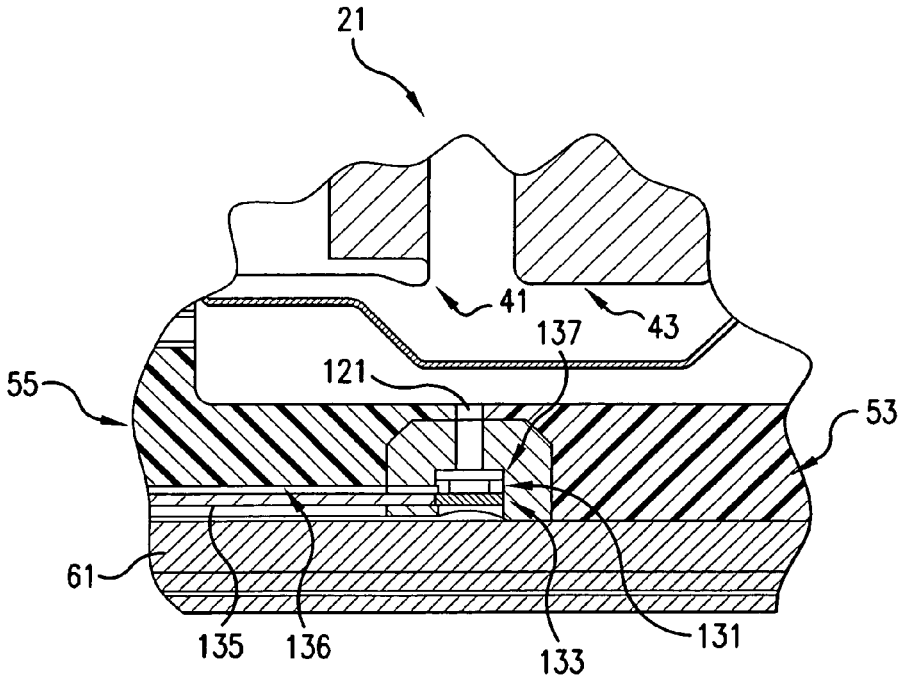
FIG. 7 is a much-enlarged partial view, in cross-section, illustrating an arc detector according to one embodiment of the invention.

One of the key features of the invention is the definition of an opening 121 (see FIG. 7) by the two parts 53 and 55 of the invention's socket member. See also FIG. 4. Understandably, it is through this defined opening that x-rays from tube 21 pass so as to function as intended (e.g., pass through luggage). FIG. 7 shows the relative positioning of the anode 43 and cathode 41 of x-ray tube 21, and how precisely opening 121 aligns with respect thereto. Relative to opening 121 (as shown), there is positioned a photo detector 131 adapted for detecting ultraviolet (UV) emissions emitted by an arc between the anode and cathode within the x-ray tube. Photo detector 131 is positioned on a printed circuit board 133 which in turn is electrically coupled to connector 33 via wiring 135 (only partly shown in FIG. 7 but understood to extend along a slot 136 (see also FIG. 4) within part 55 of the socket member adjacent shield structure 61 (the tubular portion) and then through appropriately located passages within the assembly. Such added wiring placement is considered well within the skills of one of ordinary skill in the art and further description is not deemed necessary. Positioned immediately above photo detector 131 is a UV band pass filter 137 for filtering the infrared wavelength of the tube's filament to thereby prevent overloading of the photo detector (an arc is high in UV wavelength).

In order to detect arcs within assembly 11 (but external to the tube), the invention also includes an internal microphone 141 (FIGS. 2 and 3) mounted on a second printed circuit board 143 secured to an external side of the assembly as shown, and thus within the invention's housing. The microphone (an arc detector), in conjunction with the bottom of the bellows assembly, is designed to detect arcs which pass externally of the x-ray tube and which generate a noise above one KHz. during operation of the x-ray source assembly. Detection of this sound indicates to the assembly operator that improper arcing is occurring such that the operator must then take the appropriate maintenance steps to prevent permanent damage to the tube housing. The provision of an internal microphone positioned as it is on a circuit board represents another significant aspect of this invention. Like board 133, board 143 is coupled to connector 33 through wiring (not shown) so as to receive power. The placement of such wiring, like that for arc detector 131, is within the capabilities of one skilled in the art and further description is not needed.

Thus there has been shown and described an x-ray source assembly which includes many advantageous features over known such assemblies, including, among others, the provision of a two-part lightweight socket for holding the x-ray tube in precise alignment, an internal pump for circulating cooling oil strategically through the assembly to assure optimal tube cooling, an internal microphone for detecting arcs at certain sound levels, and a photo detector positioned strategically relative to an opening defined by the socket member. In the tube housing taught herein, there are two means of arc detection. A lead shielded photo detector with a UV band pass filter is incorporated within the tube housing to detect an arc and discriminate the arc intensity. The housing also incorporates an audible arc detector, to detect an arc external to the tube but internal to the housing as a whole.

While there have been shown and described what are at present the preferred embodiments of the invention, it will be obvious to those skilled in the art that various changes and modifications may be made therein without departing from the scope of the invention as defined by the appended claims.

What is claimed is:

1. An x-ray source assembly comprising:

a housing;

an x-ray tube including a first end portion having an anode therein and a second end portion having a cathode therein, said x-ray tube adapted for emitting x-rays during operation of said x-ray source assembly;

a socket member positioned within said housing and including a first part and a second part, said first part and/or said second part defining an opening therein;

a socket base positioned substantially within said socket member, said first end portion of said x-ray tube having said anode therein being positioned within said socket base when emitting said x-rays during operation of said x-ray source assembly, said x-rays passing through said opening of said socket member; and a pump also positioned substantially within said housing for pumping oil through selected portions of said housing for cooling said x-ray tube during said operation of said x-ray source assembly, said socket base adapted for having said oil pumped by said pump pass there-through and over said x-ray tube.

2. The x-ray source assembly of claim 1 wherein said first and second parts of said socket member are comprised of polymer material.

3. The x-ray source assembly of claim 2 wherein said polymer material is polyethylene.

4. The x-ray source assembly of claim 1 wherein said first and second parts of said socket member and said socket base are comprised of polymer material.

5. The x-ray source assembly of claim 4 wherein said polymer material is polyethylene.

6. The x-ray source assembly of claim 1 further including a photo detector positioned within said housing adjacent said opening for detecting arcs within said x-ray tube during said operation of said x-ray source assembly.

7. The x-ray source assembly of claim 1 further including a microphone positioned substantially within said housing for recording sounds at established levels associated with arcs passing outside of said x-ray tube during said operation of said x-ray source assembly.

8. The x-ray source assembly of claim 1 further including a lead shielding structure positioned within said housing, said x-ray tube and said socket member being positioned within said lead shielding structure.

9. The x-ray source assembly of claim 8 wherein said lead shielding structure includes a tube member and first and second end caps secured to said tube member at opposing ends thereof so as to substantially surround said x-ray tube and said socket member.

10. The x-ray source assembly of claim 1 wherein said pump includes an impeller adapted for being rotated within said housing.

11. The x-ray source assembly of claim 1 further including a bellows positioned substantially within said housing and adapted for expanding when said oil reaches a predetermined temperature.

* * * * *

UNITED STATES PATENT AND TRADEMARK OFFICE

CERTIFICATE OF CORRECTION

PATENT NO. : 7,376,218 B2
APPLICATION NO. : 11/504609
DATED : May 20, 2008
INVENTOR(S) : Fletcher Chapin, Liza Hart and Allan Johnson It is certified that error appears in the above-identified patent and that said Letters Patent is hereby corrected as shown below:

On the Title Page
Please change: (73) Assignee: Endicott Interconnect Technologies, Inc., Endicott, NY (US)

to: (73) Assignee: SureScan Corporation Endicott, NY (US)

Signed and Sealed this

Eleventh Day of November, 2008

JON W. DUDAS
*Director of the United States Patent and Trademark Office*